United States Patent [19]

Meier et al.

[11] Patent Number: 4,505,186

[45] Date of Patent: Mar. 19, 1985

[54] LUBRICANT MONITORING SYSTEM

[75] Inventors: Hans Meier, Kollbrunn; Werner Staheli, Neuenhof, both of Switzerland

[73] Assignee: Sulzer Brothers Limited, Winterthur, Switzerland

[21] Appl. No.: 495,934

[22] Filed: May 18, 1983

[30] Foreign Application Priority Data

May 18, 1982 [CH] Switzerland ..... 3076/82

[51] Int. Cl.[3] ..... F01B 25/26; F01B 31/12; F04B 49/00; F04B 49/02

[52] U.S. Cl. ..... 92/5 R; 417/13; 417/63; 277/2

[58] Field of Search ..... 417/13, 63; 92/5, 168; 277/2; 200/61.04; 340/602, 605

[56] References Cited

U.S. PATENT DOCUMENTS 3,524,043 8/1970 Irvine ..... 200/61.04
3,815,925 6/1974 Matton ..... 277/2
3,887,196 6/1975 Renfrow ..... 277/2
3,940,754 2/1976 Weber ..... 340/605
4,128,831 12/1978 Rensch ..... 340/605
4,206,402 6/1980 Ishido ..... 340/605

FOREIGN PATENT DOCUMENTS 2811588 8/1979 Fed. Rep. of Germany ..... 417/13

*Primary Examiner*—William L. Freeh
*Attorney, Agent, or Firm*—Kenyon & Kenyon

[57] ABSTRACT

The lubricant monitoring system comprises an element which absorbs a liquid lubricant on the piston rod between a lubricant wiper assembly surrounding the same and a seal which surrounds the piston rod where the rod enters the compressor cylinder and an electrode of a measuring capacitor (CM) near the element. The lubricant absorbent element acts as the dielectric of the measuring capacitor.

In the event of a fault on the lubricant wiper assembly, liquid lubricant is absorbed by the absorbent element so that the dielectric constant changes. This can be utilized for an alarm.

16 Claims, 6 Drawing Figures

LUBRICANT MONITORING SYSTEM

This invention relates to a lubricant monitoring system. More particularly, this invention relates to a lubricant monitoring system for a reciprocating compressor.

As is known, various types of reciprocating compressors have been known for compressing gases which may cause a fire, for example oxygen. In some cases, the compressors have been constructed with a cylinder block, a crankcase mounted on the block, a reciprocally mounted piston rod which extends between the crankcase and the block and a housing part which is constructed in the fashion of a lantern with observation ports between the crankcase and cylinder block. In addition, a partition with lubricant wiper rings for wiping lubricant from the piston rod has been provided at the transition at the crankcase and the lantern housing. In like manner, a seal has been provided about the piston rod at the transition from the lantern housing to the cylinder block in order to prevent oxygen from escaping from the cylinder into the lantern housing.

Generally, a ring is clamped on the piston rod between the lubricant wiper rings and the seal in order to prevent a paper-thin film of lubricant forming on the piston rod from the crankcase from reaching the area of the seal on the cylinder block. As long as the lubricant wiper rings are intact, the paper-thin film of lubricant on the piston rod does not entail any risk of a fire since the film of lubricant does not move relative to the piston rod and cannot pass the ring which is secured on the rod. However, if the lubricant wiper rings are no longer intact or have become worn, lubricant can be entrained from the crankcase by the piston rod to such an extent as to gradually pass the clamped ring and reach the cylinder block area. In such a case, there is a resulting risk of a fire should there be contact between the oxygen and the lubricant.

Accordingly, in many countries, in order to protect operators, it has been recommended to erect protective walls, for example of concrete, in the region of any compressor which compresses gases which may cause fire. However, protective walls of this kind generally obstruct access of the operator to the compressor. If the compressor is to be observed from outside the protective wall, certain details may be missed, particularly if the protective wall is a considerable distance away from the compressor because of the space conditions required for maintenance and repair work.

Accordingly, it is an object of the invention to provide a lubricant monitoring system for detecting any progression of appreciable quantities of lubricant on a piston rod of a compressor.

It is another object of the invention to provide a lubricant monitoring system which enables a compressor to be shut-off should there be any appreciable leakage of lubricant along a piston rod of a compressor.

It is another object of the invention to provide a lubricant monitoring system for emitting an alarm in response to leakage of an appreciable amount of lubricant from a compressor along a piston rod of the compressor.

Briefly, the invention provides a lubricant monitoring system for a compressor which is constructed with a cylinder block, a crankcase mounted on the block, a reciprocally mounted piston rod extending between the crankcase and block, a lubricant wiper assembly about the piston rod between the crankcase and a seal about the piston rod at the cylinder block.

The lubricant monitoring system is comprised of at least one element which is disposed adjacent the piston rod between the wiper assembly and the seal for absorbing liquid lubricant from the rod. In addition, the system employs a first electrode near the lubricant absorbing element in order to form a measuring capacitor with the piston rod. In this case, the lubricant absorbing element forms a dielectric for the measuring capacitor.

If appreciable quantities of lubricant occur on the piston rod, the absorbing element absorbs a greater amount of lubricant and the dielectric constant of the element varies. This, in turn, has the effect of changing the capacitance of the measuring capacitor and thus any signals which are emitted from the capacitor. The signal changes can then be used to shut-off the compressor and/or trigger an alarm. Thus, there is no need for the efficiency of the lubricant wiper assembly to be determined by observation from outside or inside any protective walls. Further, there is no need to errect any protective walls or the like by the compressor.

In order to further simplify use, the electrode of the measuring capacitor is connected to another electrode which together with a static electrode with an air gap therebetween forms a coupling capacitor connected to a capacitance meter. This avoids making connections between the stationary capacitance meter and the moving electrode while also avoiding moving the meter with the piston rod.

In order to preclude any thermal influences which may have an unfavorable effect on the capacitance measurement, a second electrode of the same dimensions and configurations as the electrode of the measuring capacitor is provided on the piston rod between the lubricant absorbant element and the seal. Together with an air gap provided as a dielectric between this second electrode and the piston rod, this second electrode forms a comparison capacitor. Thus, the comparison capacitor and the measuring capacitor are subject to the same thermal influences as may occur during operation of the compressor. On each stroke of the piston rod, the capacitance of both measuring capacitor and the comparison capacitor are detected. Thus, any capacitance change due to thermal influence can be compensated.

The lubricant monitoring system may also be provided with an electronic circuit for receiving, storing and comparing signals therefrom which are representative of the resultant capacitances of the measured capacitor and comparison capacitor. The electronic circuit is constructed in order to form a differential signal corresponding to the difference between successive signals from the meter as a measure of the amount of lubricant absorbed in the lubricant absorbing element. The resultant difference signals can then be used to actuate an alarm to shut off the compressor or to indicate the measure of the lubricant absorbed in the element.

The electronic circuit may also include a high frequency oscillator for receiving and measuring these signals from the meter by frequency modulation and by subsequent demodulation. Further, the electronic circuit may include an evaluator unit which is connected to the oscillator to receive a signal corresponding to an increase in value of the resultant capacitance from the measuring capacitor. This evaluating unit may be provided with a peak detector for sequentially storing a received signal and a sample-and-hold circuit for receiving a received signal only in a bottom dead center position of the piston. The electronic circuit may be particularly useful where monitoring lubricants on a plurality of piston rods.

These and other objects and advantages of the invention will become more apparent from the following detailed description taken in conjunction with the accompanying drawings wherein.

Figure 1:
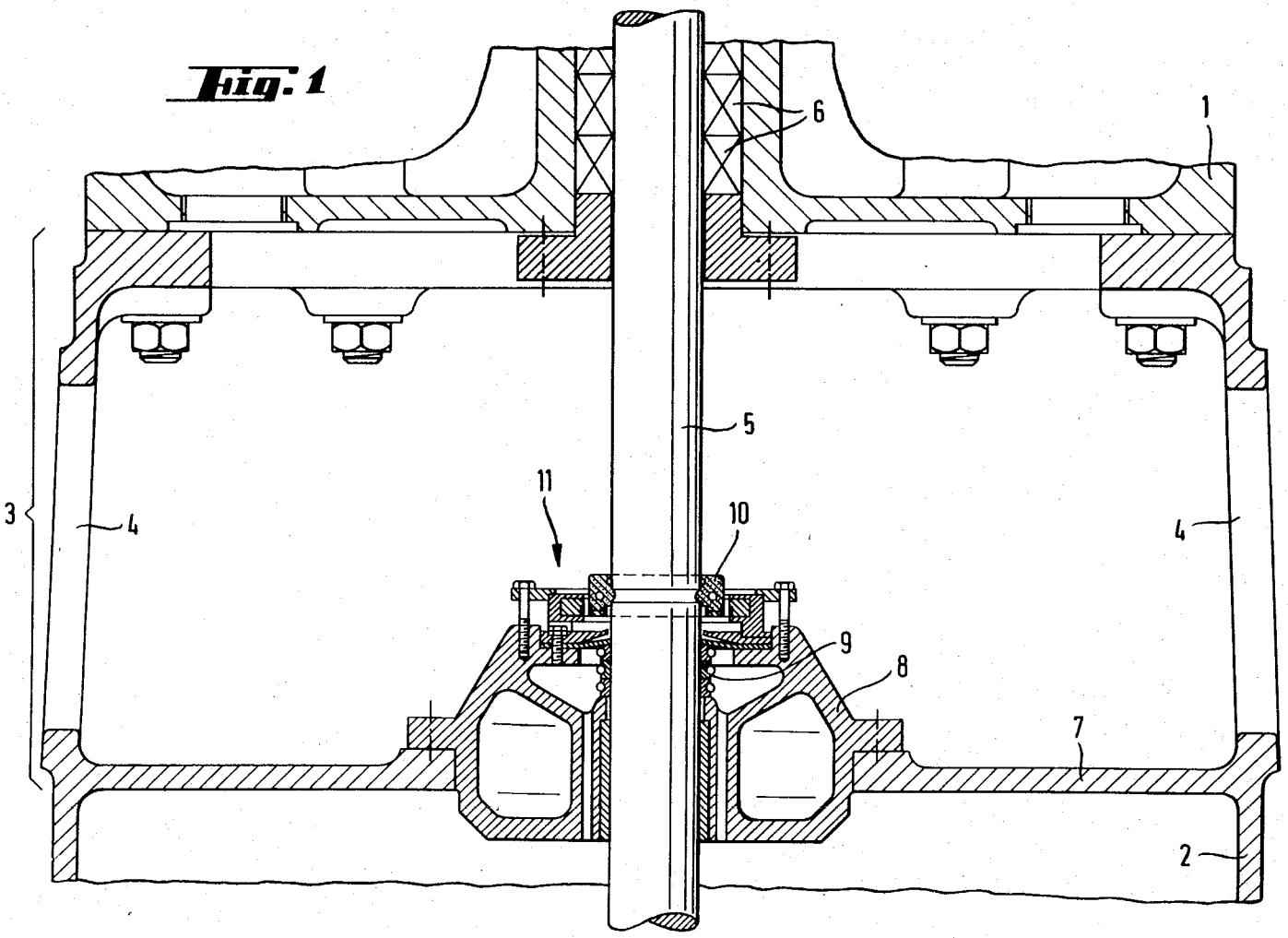
FIG. 1 illustrates a partial cross-sectional view of a compressor employing a lubricant monitoring system in accordinance with the invention.

Referring to FIG. 1, the reciprocating compressor for example for compressing oxygen comprises a cylinder block 1 and a crankcase 2 connected to the block 1 via a lantern-like part 3 in which two observation ports 4 are provided opposite one another. A piston rod 5 extends from the crankcase 2 through the part 3 into the cylinder block 1, and carries a piston (not shown) at the upper end. A seal 6 of known construction is provided at the place where the piston rod 5 passes through the cylinder block 1 while a partition 7 is provided where the piston rod 5 passes through the crankcase 2. A piston rod guide bearing 8 of known construction having a lubricant wiper assembly formed of three oil wiper rings 9 is provided in the partition 7 between the crankcase 2 and the part 3. The rings 9 ensure that lubricating oil from the crankcase 2 can form, at the most, only a paper-thin film on the vertical piston rod 5, and only as far as an oil collector 10 secured to the piston rod 5. A lubricating oil monitoring system 11, which includes parts of the oil collector 10 is disposed on the top end of the guide bearing 8 with respect to FIG. 1.

Figure 2:
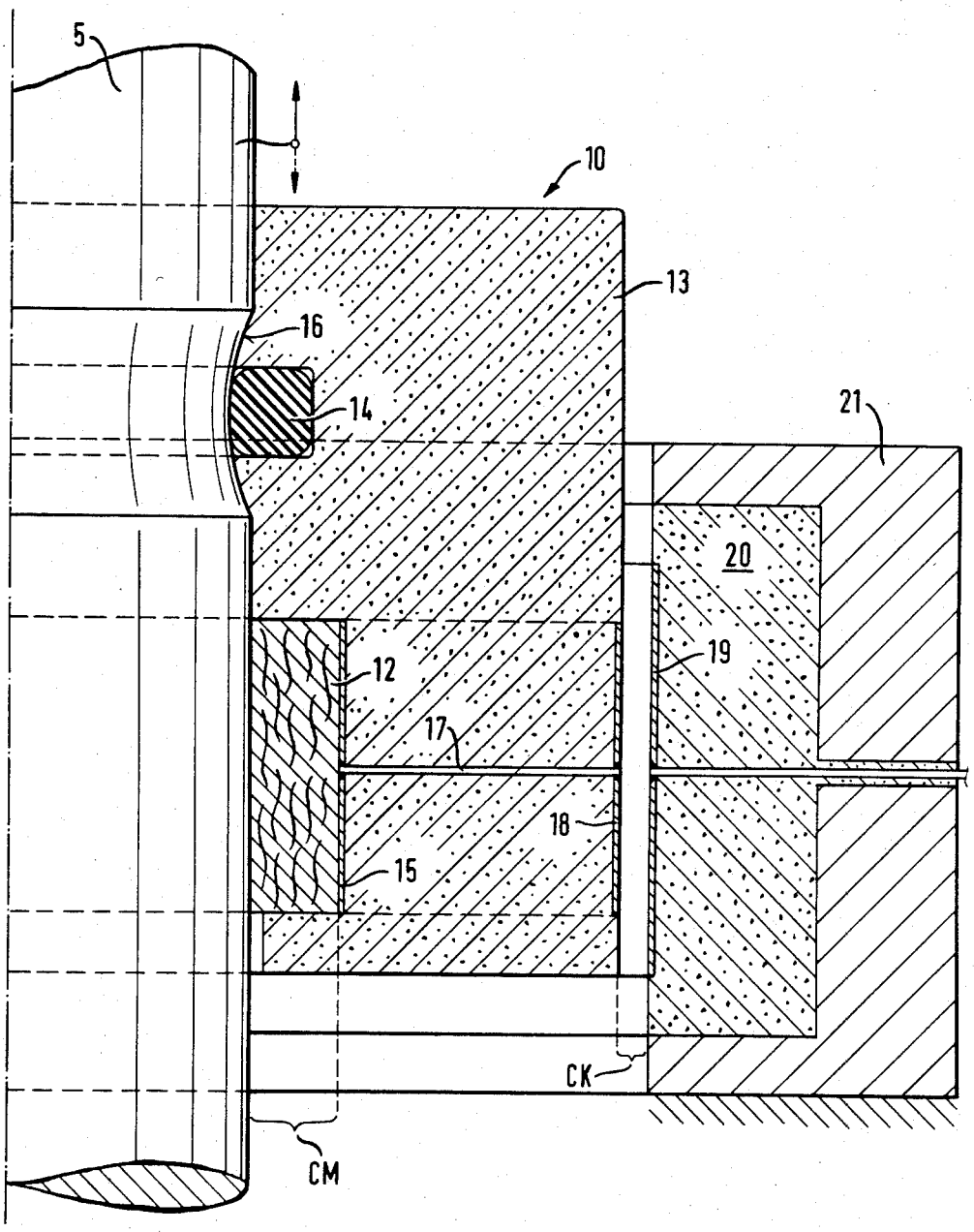
FIG. 2 illustrates an enlarged view of a measuring capacitor and coupling capacitor of the lubricant monitoring system of FIG. 1.

Referring to FIG. 2, the oil collector 10 comprises an element in the form of a ring 12 of absorbent material such as wadding or felt, an axially divided sleeve 13 of insulating material, e.g. Delrin (registered trade mark) and an O-ring 14. The sleeve 13 may be secured to the piston rod 5 by screws (not shown) or by clamping rings placed around the sleeve. To avoid axial slipping of the device on the piston rod 5, the rod 5 has a slight constriction 16 filled by the sleeve 13 and abutted by the O-ring 14.

The ring 12 which can absorb lubricating oil forms the dielectric of a measuring capacitor CM, the electrodes of which consist of the piston rod 5 and an annular metal coating 15 in the sleeve 13. The coating 15, which may for example consist of a layer of copper applied by electroplating, is electrically connected via a radial conductor 17 to another electrode in the form of an annular metal coating 18 disposed on the outer surface of the sleeve 13 and extending over the same height as coating 15. The coating 18 also advantageously consists of an electroplated copper layer.

The annular coating 18 forms one electrode of a coupling capacitor CK, the second electrode of which is formed by an annular metal coating 19 provided on an inner peripheral surface of an annular insulator 20 in the form of an electroplated copper coating. The insulator 20 may also consist of Delrin and is held in an annular electrode holder 21 secured on the housing of the piston rod guide bearing 8. The electrode 19 of the coupling capacitor CK is thus static and so disposed relative to the electrode 18 as to be opposite electrode 18 when the piston rod 5 is in the bottom dead center position (BDC). This is the position shown in FIG. 2. The electrode 19 is electrically connected to a capacitance meter via a conductor (not shown).

As the absorbent ring 12 absorbs lubricating oil, the dielectric constant $\epsilon$ varies from a value of about 1 to a value of about 2. The capacitance of the measuring capacitor CM thus varies and influences the capacitance of the coupling capacitor CK. While the piston rod 5 is in the BDC position, the resultant capacitance C is measured, this capacitance being the series circuit of the two capacitors in accordance with the formula:

$$C=(CM \cdot CK)/(CM+CK).$$

This resultant capacitance is detected by the capacitance meter and gives the operator an indication of how much oil has already advanced from the crankcase to the oil collector 10. The meter can be connected to an alarm or else directly switch off the compressor drive.

Figure 3:
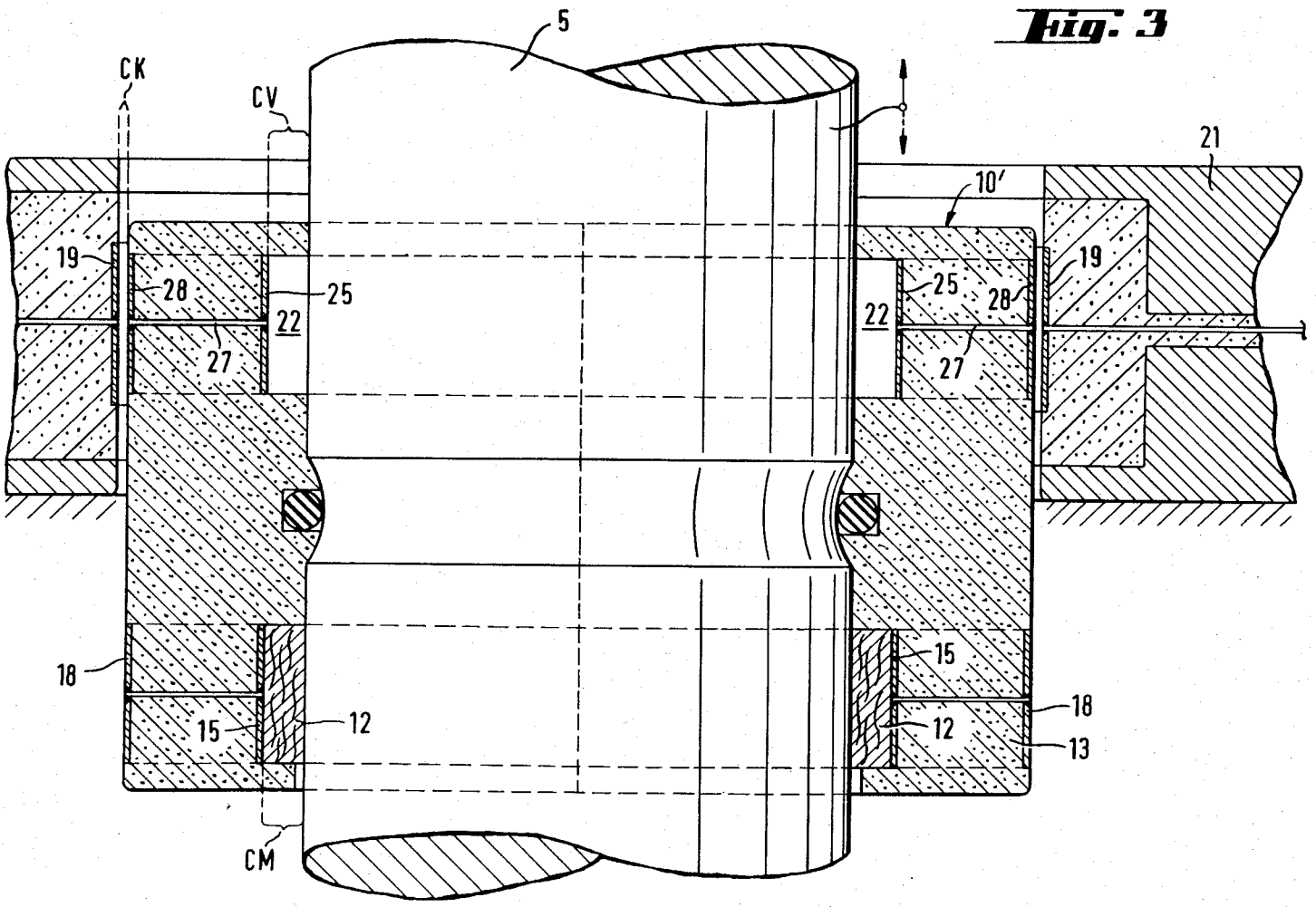
FIG. 3 illustrates a modified lubricant monitoring system having a comparison capacitor in accordance with the invention.

In comparison with this very simple embodiment of the lubricant monitoring system FIG. 3 shows a more developed embodiment in which any temperature influence on the capacitance measurement is compensated.

Referring to FIG. 3, wherein like reference characters indicate like parts as above, an oil collector 10′ includes a comparison capacitor CV in addition to the measuring capacitor CM and the coupling capacitor CK.

The comparison capacitor CV consists of an air gap 22, the dimensions and configuration of which are identical to the dimensions and configuration of the space accommodating the wadding or felt ring 12 in the measuring capacitor CM. The comparison capacitor CV also has an electrode 25 of identical size and shape to the electrode 15 of the measuring capacitor in the form of an annular metal coating on the cylinderical boundary surface of the air gap 22 in the sleeve 13. The electrode 25 is connected via a radial conductor 27 to an annular metal coating 28 which, as electrode 18, is provided on the outer surface of the sleeve 13. The comparison capacitor CV is so disposed on the piston rod 5 as to be opposite the electrode 19 of the coupling capacitor CK when the piston rod 5 is in the BDC position. Measuring capacitor CM is thus disposed at a lower point of the piston rod 5 in comparison with the arrangement shown in FIG. 2 so that on the downward movement of the piston rod 5, the measuring capacitor CM first moves past the electrode 19.

The comparison capacitor CV thus serves to establish a standard measure of capacitance with the coupling capacitor CK in order to compensate for example, for temperature changes.

Figure 4:
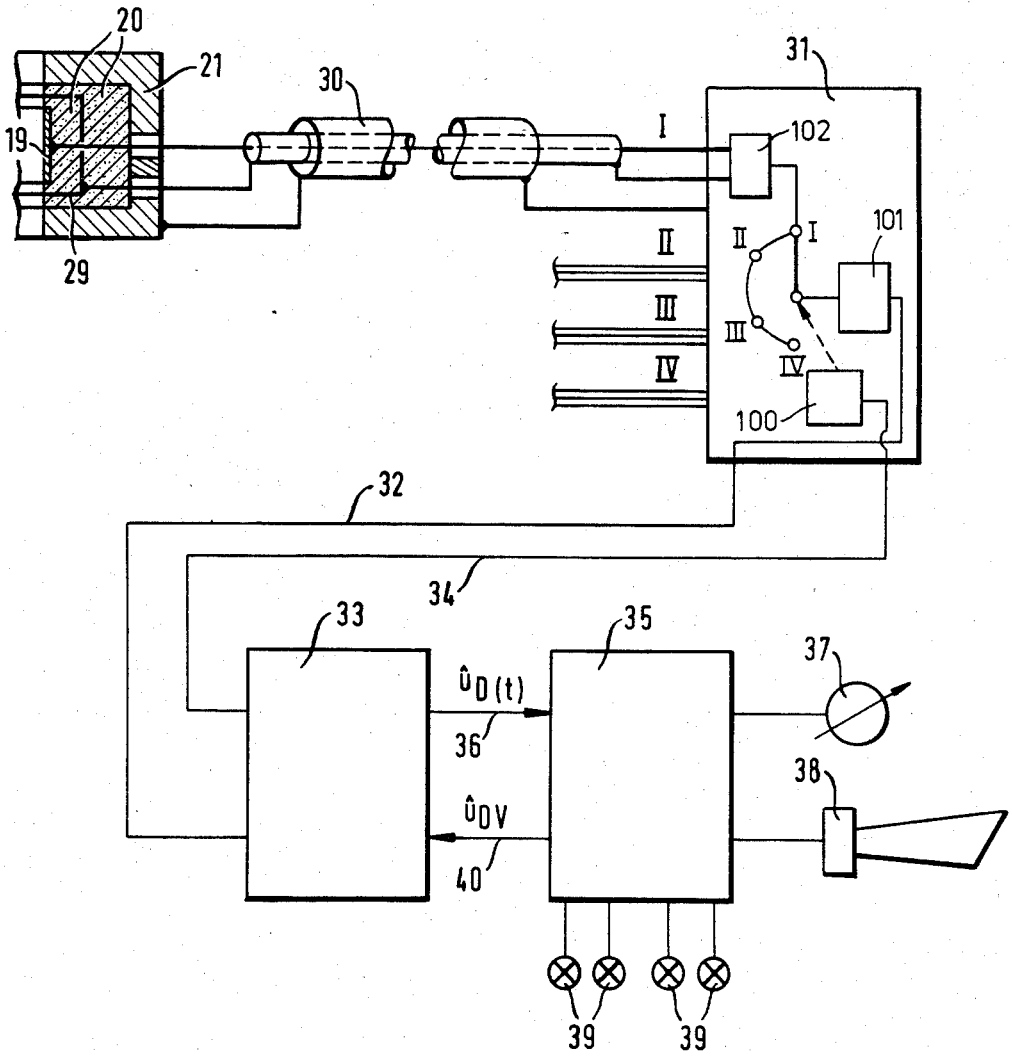
FIG. 4 illustrates a schematic view of an electronic circuit for the lubricant monitoring system in accordance with the invention.

Referring to FIG. 4, the static part of the coupling capacitor CK has a potential control electrode 29 in addition to electrode 19. This electrode 29 is embedded in the insulating material 20, the whole being embedded in the light-metal housing of the electrode holder 21, The radial distance between the movable electrodes 18 and 28, on the one hand, and the stationary electrodes 19, on the other hand, is kept as small as possible. Between these electrodes, the capacitance of the coupling capacitor CK is approximately the same for the two movable electrodes 18 and 28. Assuming that the oil collector 10' expands uniformly in response to temperature influences, the capacitance of the coupling capacitor CK undergoes the same change for the two electrodes 18 and 28. The capacitance of the coupling capacitor CK is connected in series with the respective capacitances of the measuring capacitor CM and of the comparison capacitor CV. The two capacitance values are thus detected at the connection of electrode 19:

$$CM^* = (CM \cdot CK)/(CM + CK)$$

and $$CV^* = (CV \cdot CK)/CV + CK)$$

The electrodes 19 and 29 are connected via a triax cable 30 to an electronic circuit or unit 31. Assuming that the compressor has four cylinders, there are accordingly four piston rods and four identical capacitor arrangements with four triax cable connections I to IV to the unit 31.

The electronic unit 31 in a regular cycle connects by an electronic switch 100 one of the four coupling capacitors to a high-frequency oscillator 101 in the unit 31 via the respective connections I to IV. By means of a voltage follower 102, the HF potential of the first screen of the cable 30 and hence of the control electrode 29 exactly follow the potential of the cable core and the stationary electrode 19 so that the dead capacitance is neutralized. The capacitances CM* and CV* detected by electrode 19 form part of the capacitance of the oscillatory circuit of the oscillator, the frequency of which is thus varied by variations in these values.

The oscillator HF-signal is fed via a coaxial cable 32 to a unit 33 comprising a discriminator circuit which converts the frequency variations into voltage variations. The unit 33 also contains a cyclic clock generator (not shown) which changes over the four coupling capacitors via a cable 34.

An evaluator unit 35 is also connected to the unit 33 to receive a voltage signal at an input via a line 36 connected to an output of unit 33. This signal contains information on the increase in the value of the capacitance of the measuring capacitor CM produced by the oil in comparison with the capacitance of the comparison capacitor CV, which has remained dry, this being done in a cyclic sequence for each of the four piston rods. From these variations, the evaluator unit 35 forms a measuring signal proportional to the amount of oil collected. This signal is displayed by a read-out means such as a meter 37 and is used, if required, to actuate an alarm 38. The evaluator unit 35 is also provided with four lamps 39 to indicate the change-over cycle of the four coupling capacitors, which change at intervals of about 15 seconds.

Figure 6:
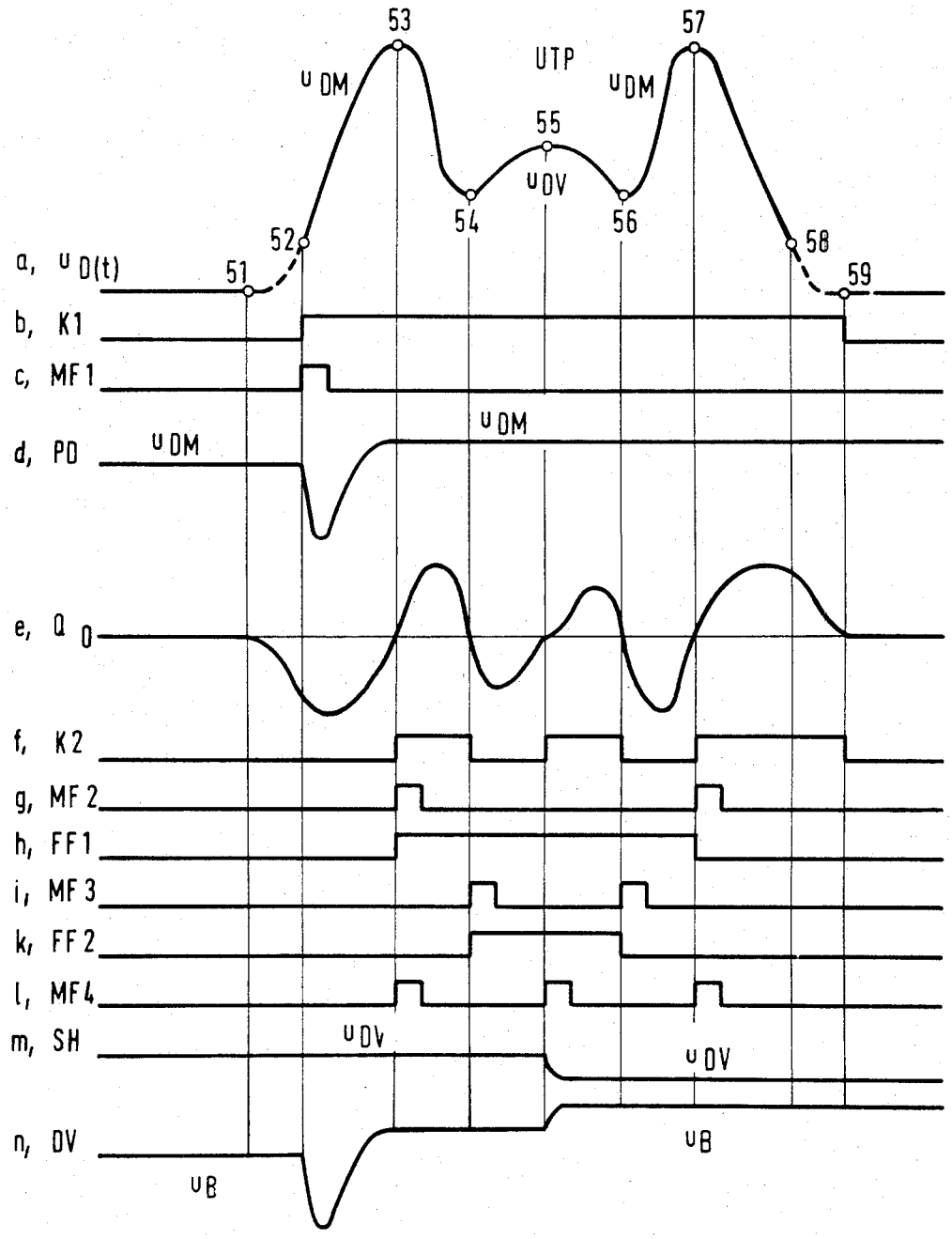
FIG. 6 graphically illustrates the operation of the electronic circuit of the lubricant monitoring system.

FIG. 6*a* is a graph plotted against time for the voltage signal $U_{D(t)}$ fed via line 36 to the evaluator unit 35 and displayed, if required, by means of an oscilloscope (not shown) connected to this unit. Point 51 of the curve corresponds to the position of the oil collector 10' of FIG. 3 far above the BDC position. Here the electrode 19 has a very small capacitance to the piston rod 5; the frequency of the oscillator in unit 31 is at a high level and the voltage at the output of the discriminator in unit 33 is at its negative saturation.

On the downward movement of the piston rod 5, electrode 18 of the measuring capacitor CM first plunges in the coupling capacitor CK. The voltage quickly rises positively to the peak 53, which is all the higher the more oil collecting in ring 12. The base 54 of the trough occurs when the electrode 19 is situated between the electrodes 18 and 28. In the BDC position, electrode 28 comes in front of electrode 19 (see FIG. 3), giving the peak 55 corresponding to the capacitance of the comparison capacitor CV. In a first approximation, this peak remains at a constant level. When the piston rod 5 continues to move upwards, the curve is continued in a mirror-image arrangement with the points 56, 57 and 59.

Figure 5:
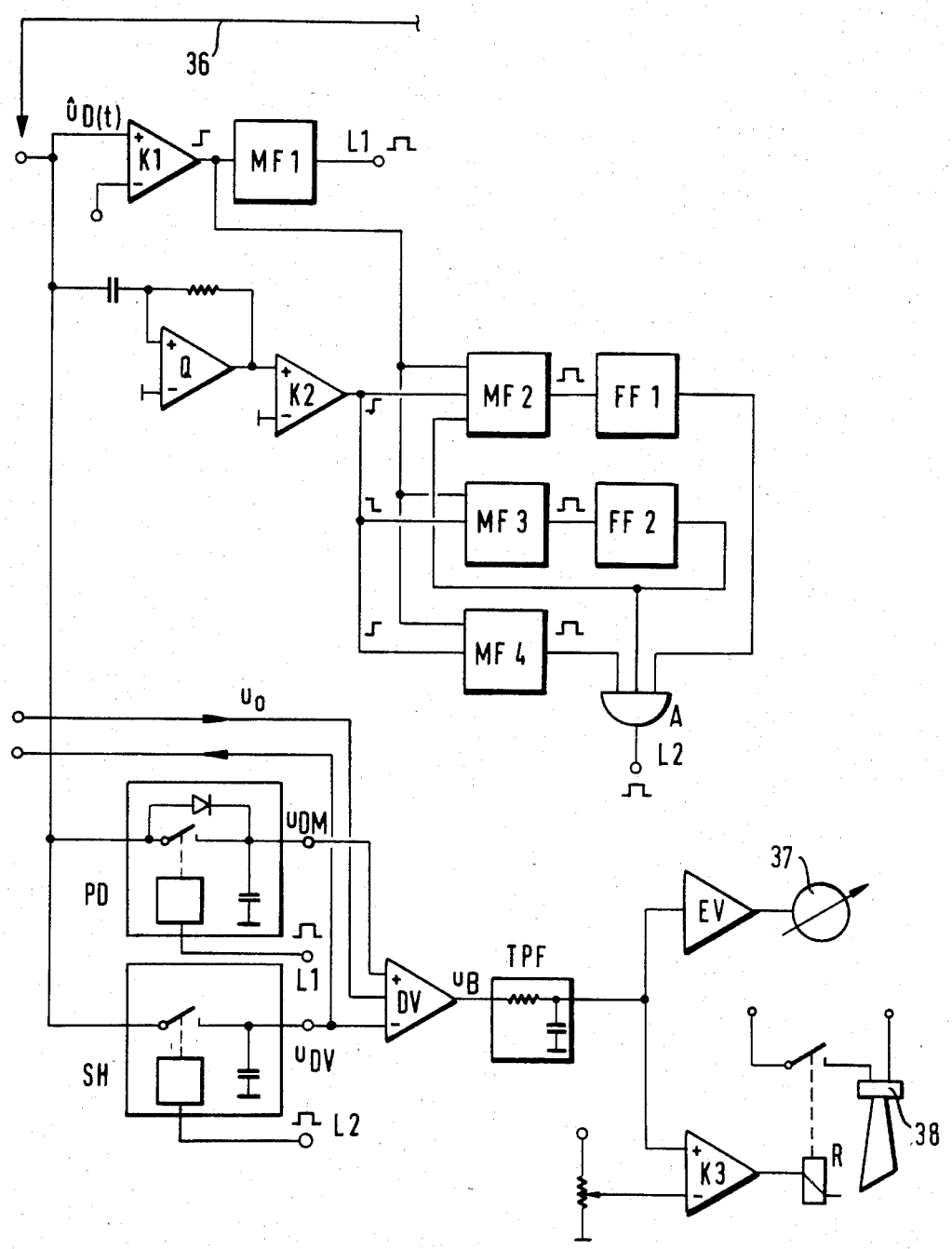
FIG. 5 illustrates a circuit diagram of an electronic evaluator of the electronic circuit.

Referring to FIG. 5, the discriminator voltage $U_D$ is first fed to the input of a comparator K1. As soon as this voltage has risen somewhat above the negative saturation value 51, corresponding to the point 52 of the curve in FIG. 6*a*, the comparator K1 changes in the positive direction (FIG. 6*b*). A monoflop MF1 is triggered as a result. A short pulse L1 is triggered in these conditions to cancel the CM voltage value stored from the previous piston stroke in a peak detector PD. If the signal voltage $U_D$ rises to the peak 53, this new value remains stored in the peak detector PD. This value is denoted by UDM.

At the BDC position (point 55), electrode 28 of comparison capacitor CV is in front of the static electrode 19. Here the signal reaches the lower peak value UDV. This value is also detected and stored for the duration of the next stroke. To this end, referring to FIG. 5, a differentiation stage Q is provided in which the signal $u_{D(t)}$ is electronically differentiated. On each peak (point 53, 55, 57) or trough (point 54, 56) of $u_D$, the output voltage of the differentiation stage Q passes through zero (FIG. 6*e*). As this figure shows, the output voltage changes sign from − to + at the peaks (points 53, 55, 57) and from + to − at the troughs (points 54, 56). These changes are used to control a comparator K2 (FIG. 5). The circuit logic following this comparator ensures that a sample-and-hold circuit SH receives a sample order only in the BDC position (point 55 in FIG. 6*a*), by means of which the value UDV is detected and remains stored. The logic comprises three monoflops MF2, MF3 and MF4 which are initially actuated by the comparator K1 as soon as its output signal at point 52 increases (FIG. 6*g*, *i*, *l*). These monoflops can therefore operate only during the measuring phase, which extends from points 51 to 59, corresponding to the movement of the oil collector 10' in the BDC zone.

At the first peak of $u_D$ (point 53), the output signal of comparator K2 (FIG. 6*f*) initially rises and triggers the monoflops MF2 and MF4 (FIG. 6*g*, *l*), the monoflop MF2 setting the flipflop FF1 by a short pulse (FIG. 6*h*).

On the first trough of $u_D$ (point 54) the output signal of comparator K2 (FIG. 6*f*) drops and triggers monoflop MF3 (FIG. 6*i*), which in turn sets flipflop FF2 (FIG. 6*k*) with a short pulse. This flipflop FF2 blocks the monoflop MF2 from any further triggering in these conditions. At the second peak of $u_D$ (point 55), the output signal of comparator K2 (FIG. 6*f*) rises again and again triggers the monoflop MF4 (FIG. 6*l*). The short pulse of monoflop MF4 now passes via and AND gate A opened by flipflops FF1 and FF2, to the sample-and-hold circuit SH (FIG. 5) and causes the peak value $u_{DV}$ to be detected, and this then remains stored.

On the second trough of $u_D$ (point 56), the output signal of comparator K2 (FIG. 6*f*) drops again, again triggers the monoflop MF3 (FIG. 6*i*), which resets the flipflop FF2 (FIG. 6*k*). The AND gate A is thus closed and the sample-and-hold circuit SH is protected from the next pulse of monoflop MF4; this pulse being triggered when the peak UDM (point 57) is again reached.

Resetting the flipflop FF2 causes monoflop MF2 to be released so that on the second peak of $u_D$ (point 57), the output signal of comparator K2 (FIG. 6*f*) rises and triggers the monoflop MF2 (FIG. 6*g*) and hence resets the flipflop FF1 (FIG. 6*h*).

On the further upward movement of piston rod 5, $u_D$ drops back to the negative saturation level (point 59).

On passage through the threshold of the comparator K1 (point 58 corresponding to point 52), the output signal of the comparator K1 falls again and blocks the monoflops MF2, MF3 and MF4. The circuit logic is thus returned to the initial state.

As will be apparent from the above description, in the BDC position, the new peak values of $u_D$ corresponding to the capacitances of the measuring capacitor CM and of the comparison capacitor CV are stored in the peak detector PD and in the sample-and-hold circuit SH, respectively. A differential amplifier DV (FIG. 5) forms the difference $u_B$ between them. This difference is balanced to zero by means of an adjustable auxiliary voltage $u_o$ for each of the four piston rods on each renewal of the felt ring 12 in the oil collector 10'. The change-over of the individual $u_o$ values is effected electronically by the same clock generator as changes over the four coupling capacitors.

To the extent that oil collects in the felt rings 12, the capacitance of the measuring capacitor CM, i.e. UDM as well, increases positively. From one stroke to the other, UDM and UDV vary very little and the same also applies to the differential voltage $u_B$. A lowpass filter TPF (FIG. 5) smooths the voltage jumps caused by recuperation of the voltage values in the peak detector PD and in the sample-and-hold circuit SH. The resulting signal is then displayed by means of the meter 37 via an output amplifier EV connected to the low-pass filter TPF. An adjustable threshold comparator K3 also connected to the low-pass filter TPF can cause the alarm 38 to be switched on via a relay R when $u_B$ reaches a given limit value.

The mean frequency of the HF oscillator in unit 31 may shift over a long period due to thermally produced variations in the capacitances of the measuring capacitor CM, the comparison capacitor CV, and the coupling capacitor CK, and also as a result of changes in the components in the oscillator itself. Although the circuit in evaluator unit 35 forms the difference between the capacitances of the measuring capacitor and the comparison capacitor, it is advantageous for the frequency discriminator in unit 33 to follow the drift of the oscillator frequency. To this end, the peak voltage UDV formed by the sample-and-hold circuit SH is fed back to unit 33 via a line 40 (FIG. 4) and is used to correct the basic level of the signal $u_{D(t)}$. This level is therefore corrected so that the voltage value UDV remains at a constant level.

Instead of the discriminator in unit 33 following the drift of the oscillator, the oscillator itself can be corrected by feeding back the voltage UDV to the unit 31 via cable 32 or 34 and using it to regulate the frequency, e.g. by means of a summing diode.

The advantage of the circuit described is that this circuit recognizes the time when the peak (point 55 in FIG. 6*a*) occurs without detecting the BDC position by other means on the compressor.

Contrary to the examples described, it is possible to use the monitoring system in compressors which do not have a piston rod guide bearing but just an assembly of oil wiper rings in the region of the partition 7. These rings also seal off the crankcase chamber from the lantern-like housing.

What is claimed is:

1. In combination with a compressor having a cylinder block, a crankcase mounted on said block, a reciprocally mounted piston rod extending between said crankcase and said block, a lubricant wiper assembly about said rod between said crankcase and said block, and a seal about said piston rod at said block;

a lubricant monitoring system comprising at least one element mounted on said piston rod between said wiper assembly and said seal for absorbing liquid lubricant from said rod and a first electrode mounted on said piston rod to form a measuring capacitor with said piston rod and wherein said element forms a dielectric for said measuring capacitor between said piston rod and said electrode.

2. The combination as set forth in claim 1 wherein said lubricating monitoring system further comprises a second electrode electrically connected to said first electrode and mounted on said piston rod, a static electrode disposed in spaced relation to said second electrode to define an air gap therebetween and to form a coupling capacitor therewith, and a capacitance meter electrically connected to said coupling capacitor to measure the resultant capacitance of said capacitors as a measure of liquid lubricant absorbed into said element.

3. The combination as set forth in claim 2 wherein said piston rod is movable between a bottom dead center position and a raised position and said static electrode is positioned opposite said second electrode at said bottom dead center position of said piston rod.

4. The combination as set forth in claim 2 where said monitoring system further comprises a third electrode mounted on said piston rod between said element and said seal at said block in axially spaced relation to said first electrode, said third electrode being spaced from said piston rod to define an air gap therebetween and to form a comparison with said rod.

5. The combination as set forth in claim 4 wherein said monitoring system further comprises a fourth electrode electrically connected to said third electrode, said fourth electrode being movable with said piston rod into a position opposite said static electrode.

6. The combination as set forth in claim 5 wherein said piston rod is movable between a bottom dead center position and a raised position and said static electrode is positioned opposite said fourth electrode at said bottom dead center position.

7. The combination as set forth in claim 1 wherein said element annularly surrounds said piston rod and said first electrode is an annular metal coating about said piston rod.

8. The combination as set forth in claim 7 wherein said monitoring system further comprises an insulating member mounting said element therein and wherein said coating is an electroplated copper coating on said member.

9. The combination as set forth in claim 8 wherein said insulating member is an axially divided sleeve.

10. The combination as set forth in claim 1 wherein said lubricating monitoring system further comprises a second electrode electrically connected to said first electrode, a static electrode disposed in spaced relation to said second electrode to define an air gap therebetween and to form a coupling capacitor therewith; a third electrode mounted on said piston rod between said element and said seal, said third electrode being spaced from said piston rod to define an air gap therebetween and to form a comparison capacitor with said rod; a capacitance meter electrically connected to said coupling capacitor to selectively measure the resultant capacitance of said measuring capacitor and said coupling capacitor as a measure of liquid lubricant absorbed into said element and the resultant capacitance of said comparison capacitor and said coupling capacitor as a standard measure of capacitance; and an electronic circuit connected to said meter for receiving, storing and comparing signals therefrom representative of said resultant capacitances, said electronic circuit forming a differential signal corresponding to the difference between successive signals from said meter as a measure of the amount of lubricant absorbed in said element.

11. The combination as set forth in claim 10 which further comprises a read-out means connected to said circuit to indicate a measure of lubricant absorbed in said element.

12. The combination as set forth in claim 10 wherein said electronic circuit includes a high frequency oscillator for receiving and measuring said signals from said meter by frequency modulation of said oscillator and by subsequent demodulation.

13. The combination as set forth in claim 12 wherein said electronic circuit further includes an evaluator unit connected to said oscillator to receive a signal corresponding to an increase in value of said resultant capacitance from said measuring capacitor, said evaluator unit having a peak detector for sequentially storing a received signal, and a sample-and-hold circuit for receiving a received signal only in a bottom dead center position of said piston rod.

14. A lubricant monitoring system for a reciprocating piston rod comprising an annular element for absorbing liquid lubricant from said piston rod passing therethrough and a first electrode about said element for forming a measuring capacitor with the piston rod and with said element forming a dielectric for said measuring capacitor.

15. A lubricating monitoring system as set forth in claim 14 which further comprises a second electrode electrically connected to said first electrode, a static electrode disposed in spaced relation to said second electrode to define an air gap therebetween and to form a coupling capacitor therewith, and a capacitance meter electrically connected to said coupling capacitor to measure the resultant capacitance of said capacitors as a measure of liquid lubricant absorbed into said element.

16. A monitoring system as set forth in claim 15 which further comprises a third annular electrode spaced from the piston rod to define an air gap therebetween and to form a comparison capacitor with the rod; and a fourth electrode electrically connected to said third electrode, said fourth electrode being movable into a position opposite said static electrode.

* * * * *